US006746099B2

(12) United States Patent
Smith et al.

(10) Patent No.: US 6,746,099 B2
(45) Date of Patent: Jun. 8, 2004

(54) AEROSOL COLLECTOR

(75) Inventors: Robert Christian Smith, San Diego, CA (US); Lluis Valles, Barcelona (ES); Antonio Monclus, Castelldefels (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/284,937

(22) Filed: Oct. 31, 2002

(65) Prior Publication Data

US 2004/0085389 A1 May 6, 2004

(51) Int. Cl.[7] ..... B41J 2/165
(52) U.S. Cl. ..... 347/34; 347/35; 347/36
(58) Field of Search ..... 347/34, 22, 29, 347/30, 31, 33, 35, 83, 90

(56) References Cited

U.S. PATENT DOCUMENTS 4,362,572 A 12/1982 Wallace
4,369,450 A * 1/1983 Iwagami et al. ..... 347/34
5,155,497 A 10/1992 Martin et al.
5,563,639 A 10/1996 Cameron et al.
5,680,162 A 10/1997 Taylor et al.
5,742,303 A 4/1998 Taylor et al.
5,774,141 A 6/1998 Cooper et al.
6,203,152 B1 3/2001 Boleda et al.
6,318,838 B1 11/2001 Anderson et al.
6,565,189 B2 * 5/2003 Yamada et al. ..... 347/36

* cited by examiner

*Primary Examiner*—Shih-Wen Hsieh

(57) ABSTRACT

In one implementation, an aerosol collector for an inkjet printer includes a partial enclosure defining a central cavity. An air passage is defined within a wall forming the partial enclosure to allow air movement into an opening defined on an inside surface of the partial enclosure and out of an exhaust outlet. A fan is configured to remove a mixture of air and aerosol from the central cavity, through the air passage and through the exhaust outlet.

28 Claims, 4 Drawing Sheets

AEROSOL COLLECTOR

BACKGROUND

In some applications, an inkjet printhead is serviced by moving the printhead into an area adjacent to a service station where ink is discharged in a process commonly called "spitting." Such discharge removes ink that has degraded in quality, such as by drying and thickening. As a result of such maintenance, print quality is increased. In some applications, overall printhead life may be extended where the printhead would have failed due to drying and hardening of ink.

Printhead servicing may create problems due to air-borne ink droplets. In particular, it is a frequent consequence of printhead servicing operations which include spitting to produce an "aerosol cloud". The aerosol cloud is a region wherein small particles of ink are suspended in air during and after printhead servicing. As the particles forming the aerosol cloud settle, a build-up of ink residue may be formed in areas within the enclosure of the printer. The ink residue may accumulate, among other locations, on mechanical components, which may come into contact with print media, thereby degrading print quality.

For these and other reasons, there is a need for the present invention.

SUMMARY

In one implementation, an aerosol collector for an inkjet printer includes a partial enclosure defining a central cavity. An air passage is defined within a wall forming the partial enclosure to allow air movement into an opening defined on an inside surface of the partial enclosure and out of an exhaust outlet. A fan is configured to remove a mixture of air and aerosol from the central cavity, through the air passage and through the exhaust outlet.

BRIEF DESCRIPTION OF THE DRAWINGS

The same reference numbers are used throughout the drawings to reference like features and components.

DETAILED DESCRIPTION

Figure 1:
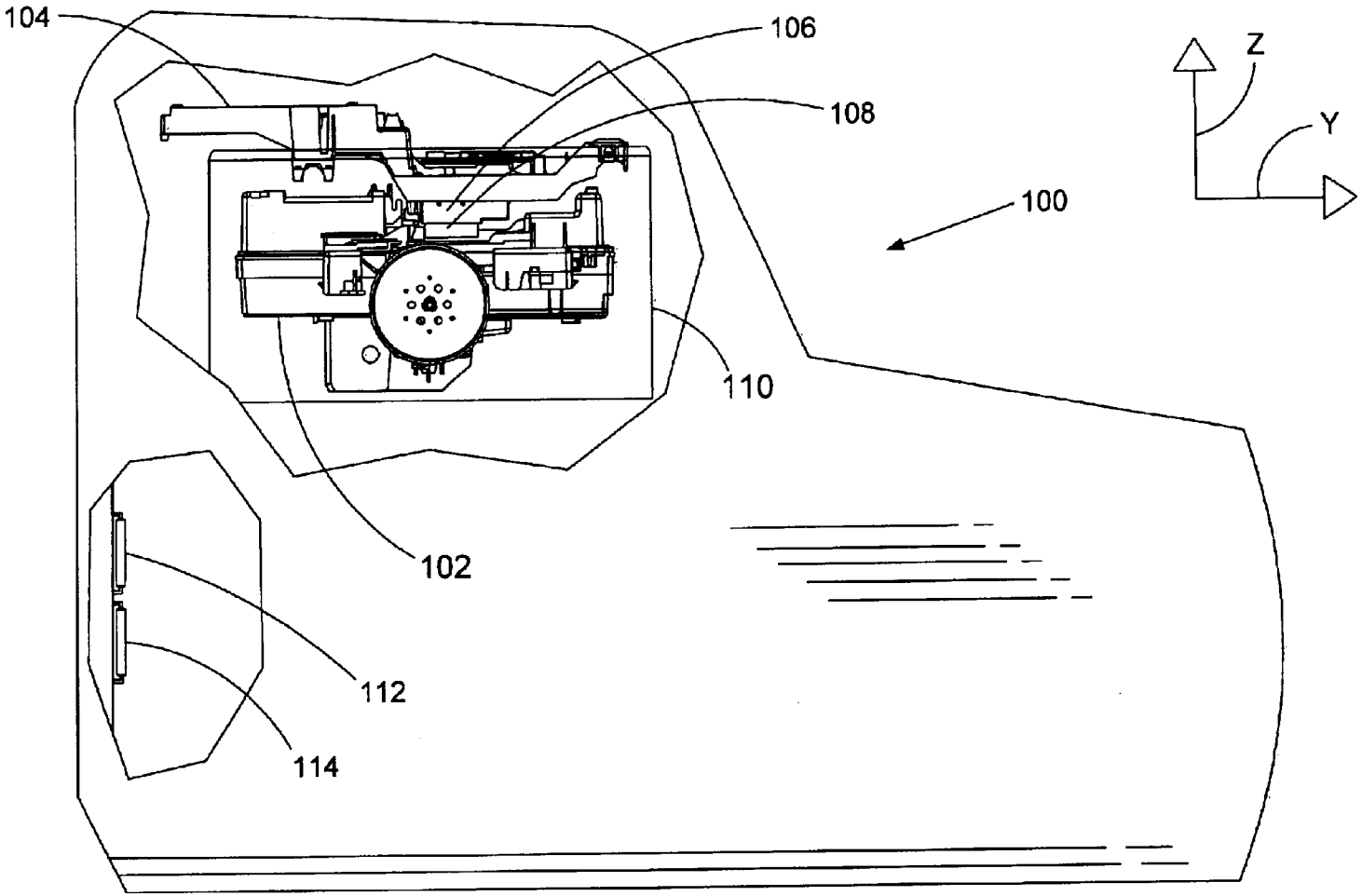
FIG. 1 is an illustration of a printer according to an embodiment of the present invention, showing a carriage, service station and an aerosol collector.

FIG. 1 shows a printer 100 having a service station 102. A carriage 104 including one or more inkjet printheads 108, typically contained in one or more print cartridges 106, is shown docked adjacent to the service station 102. An aerosol collector 110 is configured to substantially enclose the service station 102 and carriage 104. During the servicing operation, the aerosol collector 110 removes ink particles—i.e. "aerosol"—from the air. Such aerosol is generated by ink discharges performed during the servicing of the printheads 108.

A processor 112 and a ROM (read only memory) 114 device are seen in a cut-away in the printer 100. The processor is configured to execute program statements contained in the ROM 114 or other memory device. The program statements may be configured to control operation of the printer 100 generally, including the operation of the service station 102, carriage 104, printhead 106 and aerosol collector 110. In an alternative embodiment, the processor 112 may be configured as an ASIC (application specific integrated circuit) or other electronic hardware circuit; alternatively, processors, ASICs and memory devices can be used in any desired combination.

Figure 2:
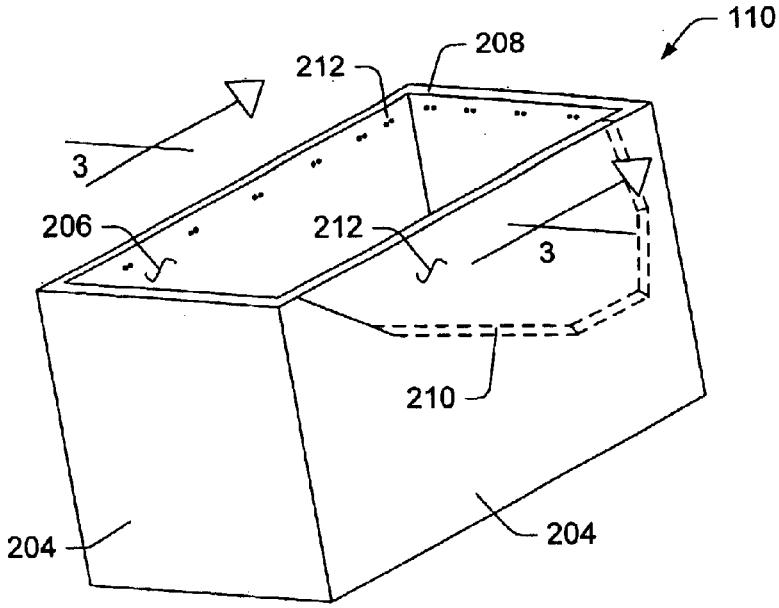
FIG. 2 is an isometric view of an embodiment of the aerosol collector seen in FIG. 1.

FIG. 2 shows an isometric view of an aerosol collector 110 similar to that seen in FIG. 1. The exemplary aerosol collector 110 is configured as a partial enclosure having walls 204, typically on five-sides. An open top 206 is defined by an upper perimeter 208. The perimeter 208 of the aerosol collector 110 may be modified by a sealing edge 210 (seen in dotted outline) contoured to allow passage of the carriage 104 through an opening 212 defined by the sealing edge 210. By configuring the sealing edge 210 according to the profile of the carriage 104, greater control is possible over aerosol within the central cavity defined within the aerosol collector 110. Accordingly, the carriage 104 is able to move into the aerosol collector 110 via movement along the X-axis (which is perpendicular to both the Y and Z axes of FIG. 1).

A plurality of openings 212 are defined on the inside surface of the partial enclosure, typically adjacent to the upper perimeter opening 208. In operation, the openings 212 allow removal of a mixture of air and aerosol (i.e. fine air-borne ink droplets) which may otherwise escape from the aerosol collector. However, due to their position adjacent to the upper perimeter open 208 defining the opening 206, the openings 212 tend to remove aerosol which would not have otherwise fallen to the floor of the aerosol collector 110, and which would have escaped from the aerosol collector 110.

Figure 3:
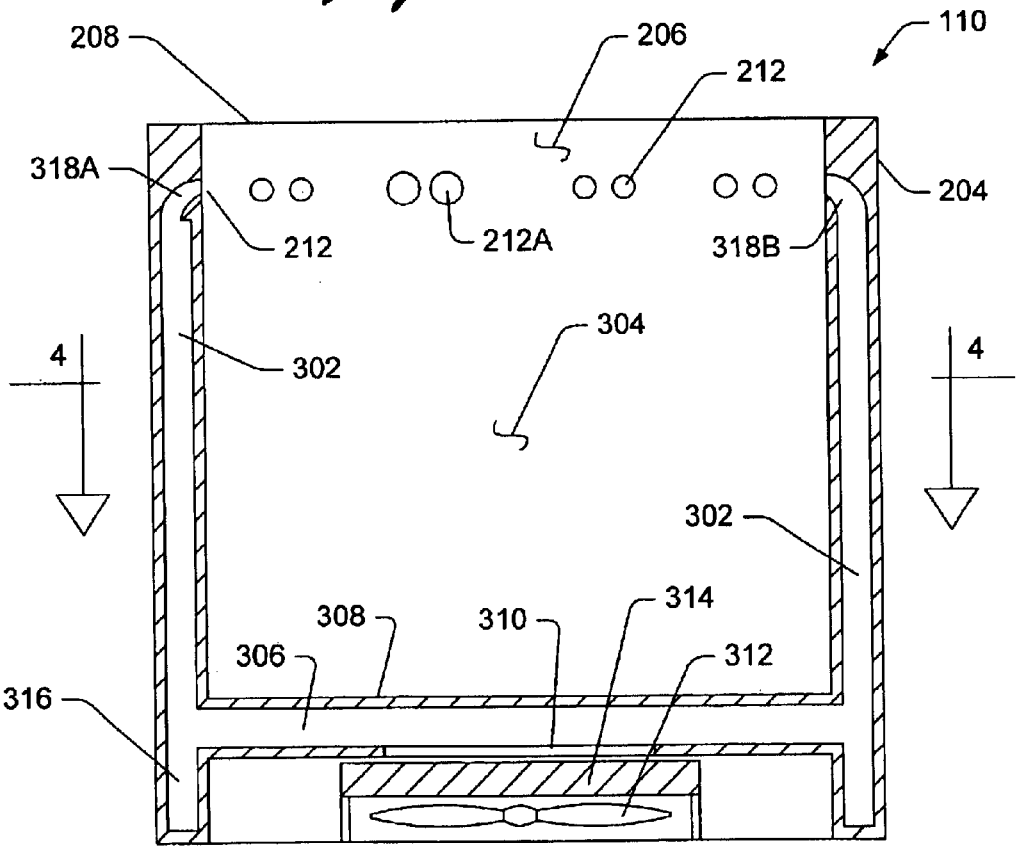
FIG. 3 is a cross-sectional view showing an embodiment of the aerosol collector of FIG. 2, taken along the 3—3 lines.

FIG. 3 is a cross-sectional view of a version of the aerosol collector 110 of FIG. 2, taken along the 3—3 lines. The interior of the walls 204 include a plurality of parallel passages 302 in air flow communication with a central cavity 304 of the aerosol collector 110 through openings 212. A plurality of radially directed passages 306 defined in a base or floor 308 of the aerosol collector 110 connects the plurality of parallel passages 302 to an exhaust outlet 310. A fan 312 drives a mixture of air and aerosol removed from the central cavity 304 through a filter 314, which removes some or most of the aerosol from the air.

A mixture of air and aerosol moving through the plurality of parallel passages 302 may swirl about a collection trough 316, which is defined in a lower portion of the parallel air passages 302 and is configured for ink residue containment. In one implementation, the collection trough may be a dead-end passage defined in one or more of the parallel passages 302. The collection troughs 316 tend to result in changes in the air-speed of the air and aerosol mixture which allows some of the aerosol to adhere to the walls of the collection trough 316, and therefore to remain within the collection trough 316. The selection and operation of the fan 312 additionally results in air and aerosol movement at a speed or rate which tends to allow aerosol to be deposited within the collection troughs 316. Additional aerosol is removed, as seen above, by the filter 314.

In some embodiments, the rate at which air is drawn through any particular opening 212 or 212A may be controlled. Such control allows aerosol to be removed more efficiently by removing greater volumes of a mixture of air and aerosol from areas where the presence of aerosol is higher, and by removing smaller volumes of mixed air and aerosol from areas where the presence of aerosol is lower.

In one embodiment, by forming passages which are relatively restricted (e.g. the air flow restrictions of restricted passage 318A) or relatively open (e.g. open passage 318B) the relative rates of air movement through any given passage 302, 306 may be controlled. In another embodiment, by using openings which are smaller (i.e. having greater air flow restrictions) or larger (e.g. openings 212 and 212A) the rate of movement of mixed air and aerosol through the openings may be controlled.

Figure 4:
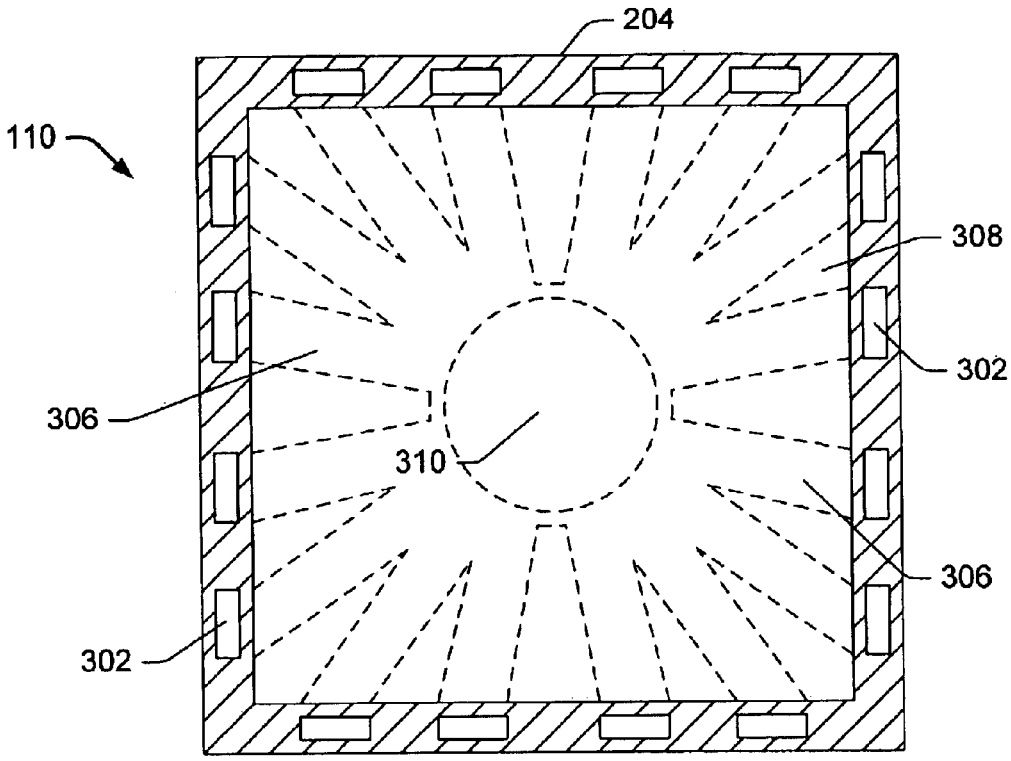
FIG. 4 is a cross-sectional view showing an embodiment of the aerosol collector of FIG. 3, taken along the 4—4 lines.

FIG. 4 is a cross-sectional view of the aerosol collector 110 of FIG. 3, taken along the 4—4 lines. The parallel passages 302 are seen in cross-section, connecting to radially directed passages 306, contained within the base 308. Since the radially directed passages are contained within the base 308, they are seen in dotted outline. The exhaust outlet 310 is also seen in dotted outline, since this feature is obscured by an upper surface of the base 308.

Figure 5:
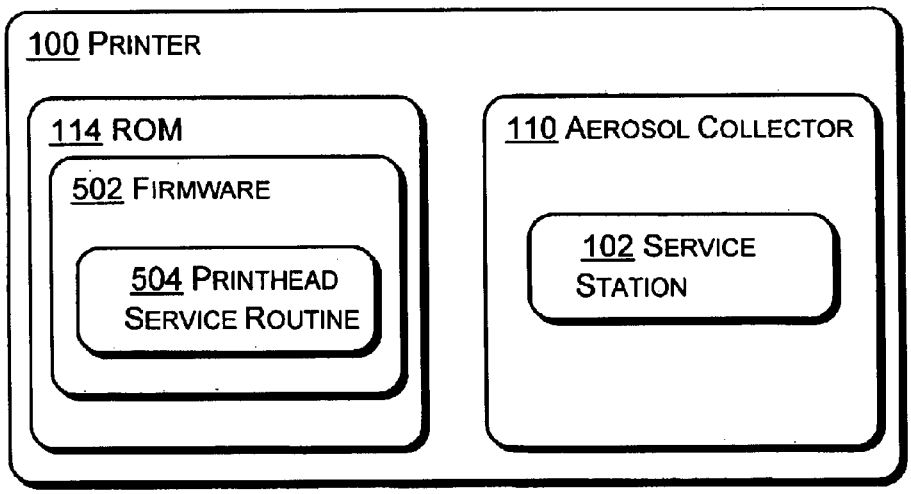
FIG. 5 is a block diagram of a printer according to an embodiment of the present invention illustrating an implementation of software configured to operate an exemplary aerosol collector.

FIG. 5 shows one possible implementation of a printer 100 including an aerosol collector 110. In a configuration similar to that seen in FIG. 1, a service station 102 is partially enclosed by an aerosol collector 110. Firmware 502 may be defined on a ROM 114 or alternate memory device. A printhead service routine 504 controls operation of the fan 312, in addition to typical servicing functionality. The fan 312 is operated during at a time, and at a rate, which results in removal of the most aerosol from the central cavity 304 of the aerosol collector 110 with the least noise, power consumption and unnecessary air circulation.

Figure 6:
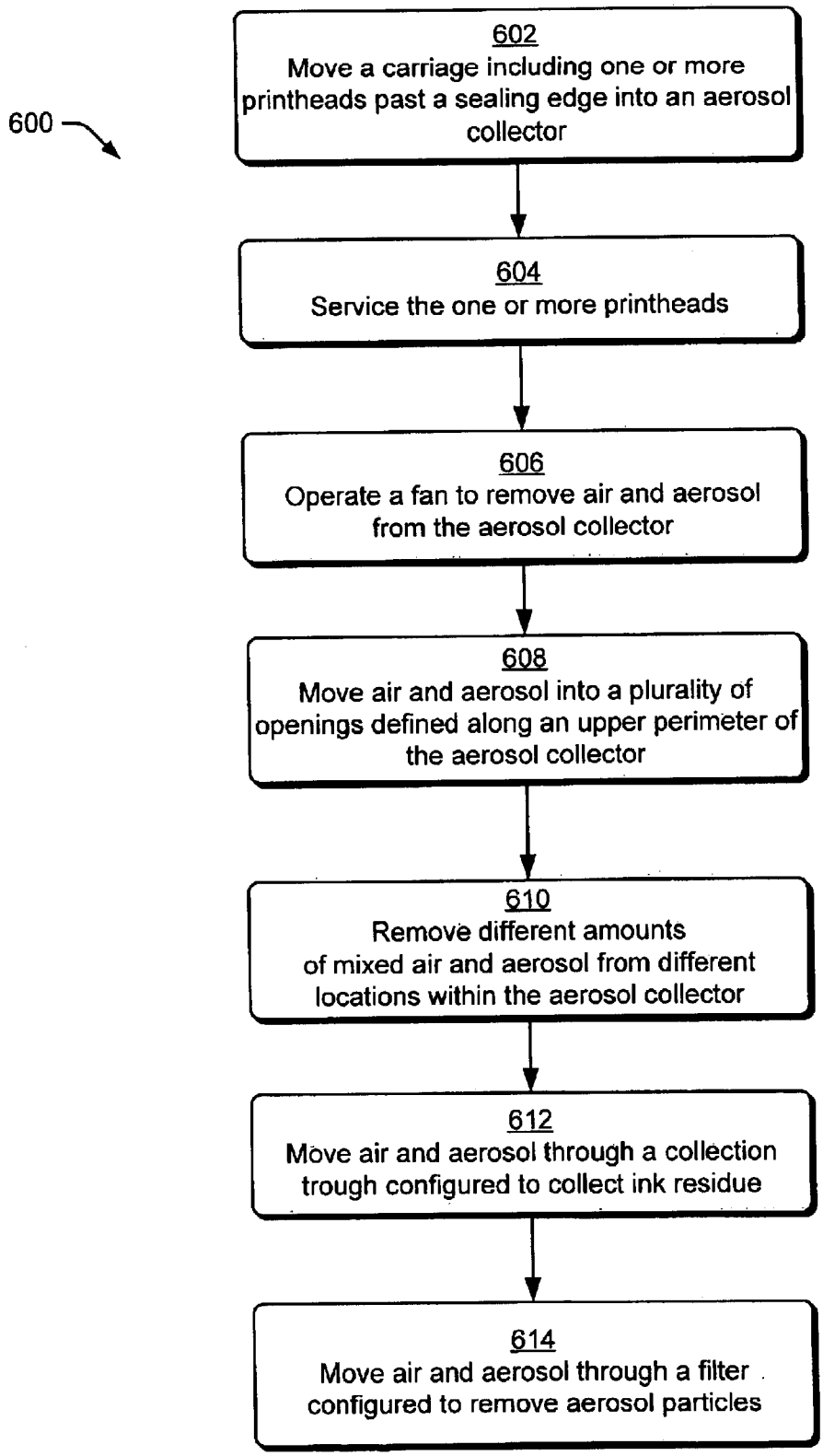
FIG. 6 is a flow diagram that describes one embodiment according to the present invention of a method to remove aerosol from the air in the vicinity of a printer's service station.

FIG. 6 shows an exemplary implementation of a method to remove aerosol from the air in the vicinity of a printer's service station. The elements of the method may be performed by any desired means. In one embodiment, the ROM 114 may contain program statements implementing the firmware module 502 of FIG. 5 according to an exemplary method as seen in the flow chart of FIG. 6. In an alternative embodiment, an ASIC may contain logic which implements the functionality of firmware module 502 according to an exemplary method as seen in the flow chart of FIG. 6.

At block 602, a carriage 104 is moved into an aerosol collector 110. The carriage may include at least one print cartridge 106 having one or more printheads 108 to be serviced. In one embodiment, the carriage 104 is moved into the aerosol collector 110 through an opening in the collector 110 having a sealing edge 210. The sealing edge 210 is configured to allow carriage passage into the central cavity 304, while allowing the partial enclosure of the aerosol collector 110 to substantially enclose the carriage 104.

At block 604, the printheads 108 contained within the print cartridge 106 supported by the carriage 104 are serviced. In general, servicing entails "spitting" by the printheads, thereby removing partially degraded ink from the printheads. Such discharges frequently result in aerosol becoming suspended in the air cavity 304 of the aerosol collector 110.

At block 606, a fan 312 is operated to remove air and aerosol from the central cavity 304 of the aerosol collector 110. At block 608, air and aerosol are moved into a plurality of openings 212 defined along—or adjacent to—an upper perimeter 208 of the inside surface of the aerosol collector 110. At block 610, in an optional embodiment, different amounts of mixed air and aerosol are removed from different locations within the aerosol collector. Larger amounts of mixed air and aerosol are removed from locations where the concentration of aerosol is greater, and smaller amounts of mixed air and aerosol are removed from locations where the concentration of aerosol is smaller. At block 612, air and aerosol are moved through a collection trough 316 configured to collect ink residue. As the air and aerosol move through the collection trough 316, some of the aerosol is deposited within the collection trough 316. The remaining aerosol and air then into the radially directed passages 306. At block 614, the air and aerosol move through a filter 314 configured to remove most of the remaining aerosol particles.

Although the disclosure has been described in language specific to structural features and/or methodological steps, it is to be understood that the appended claims are not limited to the specific features or steps described. Rather, the specific features and steps are exemplary forms of implementing this disclosure. For example, while exemplary parallel passages 302 and radially directed passages 306 have been illustrated, other passage configurations could alternatively be constructed using the strategies conveyed herein. Additionally, actions described in any block of the method to remove aerosol may be performed in parallel with actions described in other blocks, may occur in an alternate order, or may be distributed in a manner which associates actions with more than one other block.

Additionally, while one or more methods have been disclosed by means of flow charts and text associated with the blocks, it is to be understood that the blocks do not necessarily have to be performed in the order in which they were presented, and that an alternative order may result in similar advantages.

What is claimed is:

1. An aerosol collector, comprising:

a partial enclosure defining a central cavity;

an air passage defined within a wall forming the partial enclosure to allow movement of mixed air and aerosol through an opening defined on an inside surface of the partial enclosure and through an exhaust outlet; and a fan to remove the mixed air and aerosol from the central cavity, through the air passage and the exhaust outlet.

2. The aerosol collector of claim 1, additionally comprising:

a filter positioned within the aerosol collector such that the mixed air and aerosol passes through the filter during the movement.

3. The aerosol collector of claim 1, wherein a plurality of openings in communication with the air passage are defined on the inside surface of the partial enclosure adjacent to an upper perimeter.

4. The aerosol collector of claim 1, additionally comprising:

at least one collection trough, in communication with the air passage, to collect ink residue.

5. The aerosol collector of claim 1, additionally comprising:

a sealing edge defining an opening into the central cavity configured to allow carriage passage to the central cavity.

6. The aerosol collector of claim 1, wherein the air passage comprises:

a plurality of parallel passages in air flow communication with the central cavity; and a plurality of radially directed passages connecting the plurality of parallel passages to the exhaust outlet.

7. The aerosol collector of claim 1, additionally comprising:

air flow restrictions in at least one restricted air passage to result in diminished movement of the air and aerosol through the restricted air passage such that a greater amount of mixed air and aerosol is removed from the aerosol collector in areas of greater aerosol concentration and a lesser amount of mixed air and aerosol is removed from the aerosol collector in areas of lesser aerosol concentration.

8. The aerosol collector of claim 7, wherein the air flow restrictions include at least one larger diameter opening defined on the inside surface of the partial enclosure and at least one smaller diameter opening defined on the inside surface of the partial enclosure.

9. A processor-readable medium comprising processor-executable instructions for:

moving a carriage including one or more printheads into an aerosol collector;

servicing the one or more printheads; and operating a fan to remove a mixture of air and aerosol from a central cavity within the aerosol collector, through an air passage defined within a wall forming the aerosol collector, and through an exhaust outlet.

10. A processor-readable medium as recited in claim 9, comprising further instructions for:

operating the fan to move the mixture of air and aerosol through a plurality of openings defined along an upper perimeter of an inside surface of the wall.

11. A processor-readable medium as recited in claim 9, comprising further instructions for:

operating the fan to move the mixture of air and aerosol through a collection trough so as to facilitate ink residue deposition within the collection trough, wherein the collection trough is defined by the air passage and is configured for ink residue containment.

12. A processor-readable medium as recited in claim 9, wherein operating the fan comprises further instructions for:

operating the fan to move the mixture of air and aerosol through a filter configured to remove the aerosol from the mixture.

13. A service station for a printer, comprising:

an enclosure wall defining a cavity sized to receive a carriage;

an air passage defined within the enclosure wall to allow air movement through an opening defined on an inside surface of the enclosure wall and through an exhaust outlet; and a fan to remove air and aerosol from the service station through the air passage and the exhaust outlet.

14. The service station of claim 13 wherein the inside surface of the enclosure wall additionally defines a plurality of openings arrayed along an upper perimeter, the openings in communication with a plurality of air passages.

15. The service station of claim 14 wherein the plurality of openings are of greater and lesser diameter to remove corresponding greater or lesser quantities of mixed air and aerosol.

16. The service station of claim 13, additionally comprising:

a collection trough, defined by a dead-end passage in communication with the air passage, to collect ink residue.

17. The service station of claim 13, additionally comprising:

a filter, located in air flow driven by the fan, to remove particles from the air flow.

18. The service station of claim 13, additionally comprising:

an upper edge of the enclosure wall having a sealing edge contoured to allow carriage passage.

19. The service station of claim 13, wherein the air passage additionally comprises:

parallel passages allowing movement of air entering openings defined on the inside surface; and radially directed passages connecting the parallel passages to the exhaust outlet.

20. A printer, comprising:

means for moving a carriage including at least one printhead into an aerosol collector;

means for servicing the at least one printhead while inside the aerosol collector; and means for operating a fan to drive air out of the aerosol collector, through an air passage defined within a wall forming the aerosol collector, and through an exhaust outlet.

21. A printer of claim 20, additionally comprising:

means for directing fan operation to result in air movement through a plurality of openings defined on an inside surface of the aerosol collector, wherein the plurality of opening are defined along an upper perimeter opening of the aerosol collector.

22. A printer of claim 21, wherein openings included among the plurality of openings are configured to remove quantities of mixed air and aerosol according to aerosol concentration.

23. The printer of claim 20, additionally comprising:

means for controlling fan operation to result in air movement through a collection trough, wherein the collection trough is defined by the air passage, to result in collection of ink residue within the collection trough.

24. A printer of claim 20, additionally comprising:

means for controlling fan operation to result in air movement through a filter configured to remove aerosol particles.

25. A method for removing aerosol from air, comprising:

moving a carriage through a sealing edge defining an opening into a central cavity of an aerosol collector, the sealing edge configured to allow carriage passage to the central cavity while substantially enclosing the carriage;

servicing at least one printhead carried by the carriage by discharging ink from the at least one printhead; and operating a fan to withdraw air from the aerosol collector and through a filter configured to remove an aerosol form of the ink from the air.

26. The method of claim 25, additionally comprising:

directing air movement through a collection trough at a speed which results in ink residue build-up within the collection trough.

27. A processor-readable medium comprising processor-executable instructions for:

moving a printer carriage into a servicing location defined at least in part by a sealing edge forming an opening into a central cavity of an aerosol collector, wherein the sealing edge is configured to allow carriage passage to the central cavity while substantially enclosing the carriage;

servicing at least one printhead carried by the carriage by discharging ink; and operating a fan to withdraw a mixture of air and aerosol from the aerosol collector via a plurality of openings defined along the sealing edge and an upper perimeter of the aerosol collector.

28. A processor-readable medium as recited in claim 27, additionally comprising fan operation instructions for:

directing air movement through a collection trough, thereby facilitating ink residue deposition within the collection trough, wherein the collection trough is defined by an air passage in communication with the fan, and is configured to collect ink residue; and directing air movement through a filter configured to remove aerosol particles.

* * * * *